United States Patent [19]

Housel

[11] Patent Number: 5,072,261

[45] Date of Patent: Dec. 10, 1991

[54] DUPLEX COPIER APPARATUS WITH CHAPTERIZATION

[75] Inventor: Edward M. Housel, Rochester, N.Y.

[73] Assignee: Eastman Kodak Company, Rochester, N.Y.

[21] Appl. No.: 348,831

[22] Filed: May 8, 1989

[51] Int. Cl.[5] ..... G03G 21/00

[52] U.S. Cl. ..... 355/313

[58] Field of Search ..... 355/24, 25, 313, 314, 355/319

[56] References Cited

U.S. PATENT DOCUMENTS

| | | | |
|---|---|---|---|
| 4,453,821 | 6/1984 | Smith | 355/313 |
| 4,640,607 | 2/1987 | Bray | 355/313 |
| 4,712,908 | 12/1987 | Nakayama et al. | 355/319 X |

*Primary Examiner*—Fred L. Braun

*Attorney, Agent, or Firm*—Milton S. Sales

[57] ABSTRACT

A copier for producing a set of duplex copies from a set of originals in which the copy set has subsets in which the first page of each subset is on the back side of a copy. The copier includes an image-producing section for producing images of originals at an exposure position; a circulating feeder for receiving a set of originals at a receiving position and for sequentially circulating individual orignals from the receiving position to the exposure position of the producing section and then back to the receiving position. A supply of copy sheets is provided to selectively supply copy sheets to the producing section to receive images on both sides thereof. The copier includes a logic and control unit operable in a setup mode for controlling the circulating feeder to circulate originals one at a time under operator control. An operator actuable switch is provided to designate individual original pages which are to be the first pages of subsets of duplex copies. The control unit also is operable in a producing mode for controlling the circulating feeder to circulate the originals to the exposure position; for controlling the producing section to produce sequential images of the original; and for controlling the copy sheet supply to supply to the producing section copy sheets to receive images of original pages on the front and back sides of copy sheets with the designated first page of each subset being received on the back side of a copy sheet.

5 Claims, 5 Drawing Sheets

DUPLEX COPIER APPARATUS WITH CHAPTERIZATION

BACKGROUND OF THE INVENTION

This invention relates to copier apparatus for copying a set of originals to produce a set of duplex copies having subsets in which the first page of each subset is on the back side of a copy sheet.

Commonly assigned U.S. Pat. No. 4,640,607 which issued to R. L. Bray, on Feb. 3, 1987 discloses a copier which can produce a duplex copy set from a simplex original set in which the copy set is segmented into subsets (also referred to as chapters) with the first page of each subset being copied on the front side of a copy sheet.

While the Bray patent is useful in providing what has become known as "chapterization," it would be desirable to provide a copier in which a set of duplex or simplex originals could be automatically copied as duplex copies segmented into subsets with the first page of each subset being guaranteed to be copied on the back side of a copy sheet. In this manner, an operator could insure that two related sequential pages would be grouped so that they would simultaneously be visible to a reader when the copy set is bound or otherwise formed as a book. For example, FIG. 1 shows an open notebook wherein the information on, say, page 5 is intended to be viewed in conjunction with the information on the succeeding page 6. As another example, a drawing on one page would be visible to a user reading the description of the drawing from an adjacent page.

SUMMARY OF THE INVENTION

According to the present invention, there is provided apparatus for copying a set of simplex or duplex originals to produce a set of duplex copies having subsets in which the first page of each subset is on the back side of a copy sheet.

In accordance with a preferred embodiment, the apparatus includes producing means for producing images of originals and having an exposure position; a circulating means for receiving a set of originals at a receiving position and for sequentially circulating individual originals from the receiving position to the exposure position and then back to the receiving position; and supply means for selectively supplying copy sheets to receive images from the producing means. The apparatus also includes control means operable in a setup mode for controlling the circulating means to circulate originals one at a time under operator control wherein the control means includes an operator actuatable means for designating individual sides of originals as the first pages of subsets. The control means is also operable in a producing mode for controlling the circulating means to circulate originals to the exposing position for controlling the producing means to produce sequential images of the originals and for controlling the supply means to supply to the producing means copy sheets to receive images of originals on the front and back sides of the copy sheets with a designated first page of each subset being received on the back side of a copy sheet.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, like numbers indicating like elements in which.

DESCRIPTION OF THE PREFERRED EMBODIMENT

Duplex copies or prints may be formed according to a number of techniques well known to those skilled in the art. For example, double pass duplex copying is described in above-noted U.S. Pat. No. 4,640,607, while single pass duplex copying from either simplex or duplex originals is disclosed in commonly assigned U.S. Pat. No. 4,174,905 which issued on Nov. 20, 1979 to A. B. DiFrancesco and C. T. Hage. The duplex technique of the latter patent will be described herein as the preferred embodiment.

Figure 2:
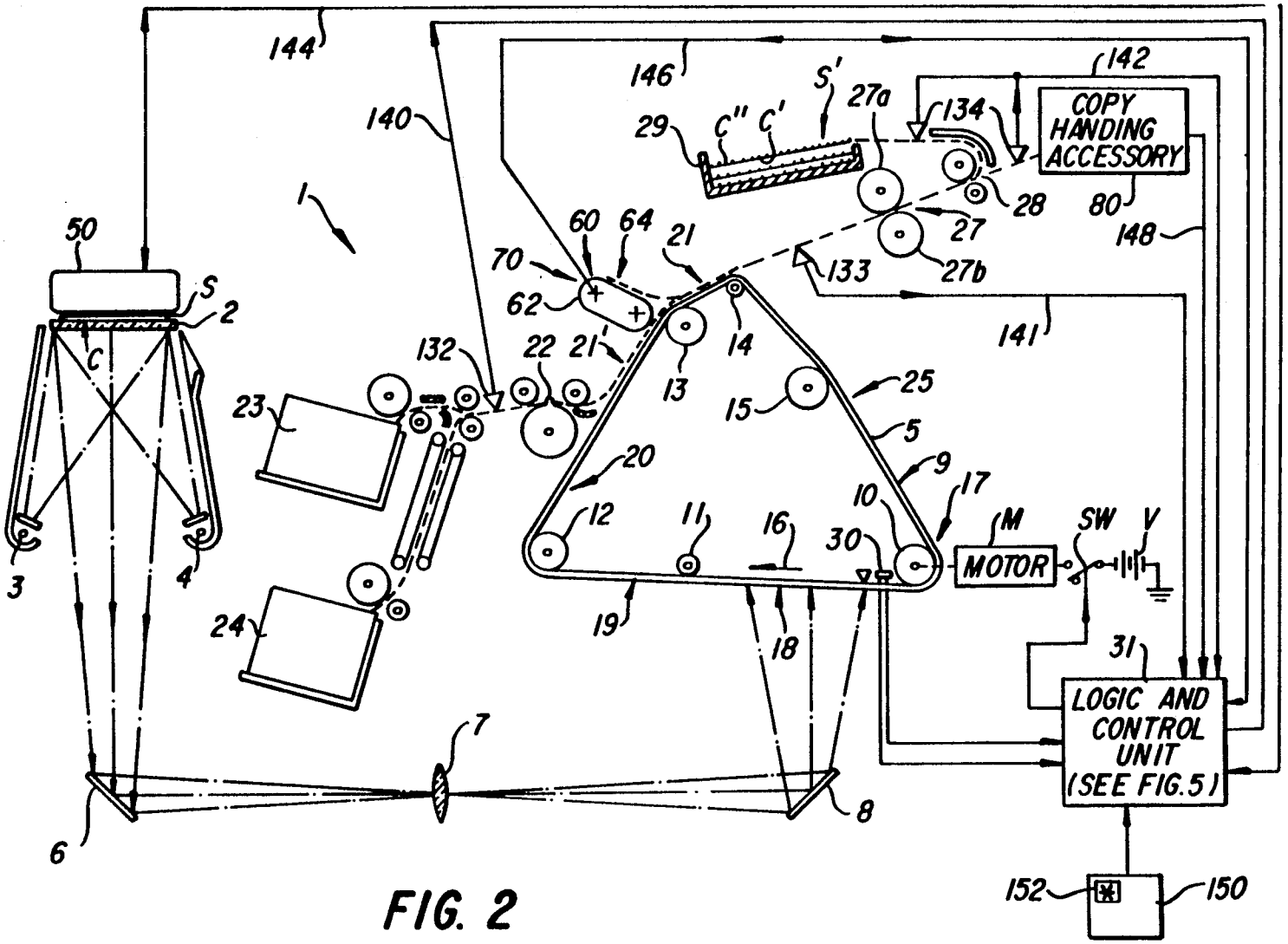
FIG. 2 is a schematic diagram of copier apparatus according to a preferred embodiment of the present invention.
Figure 3:
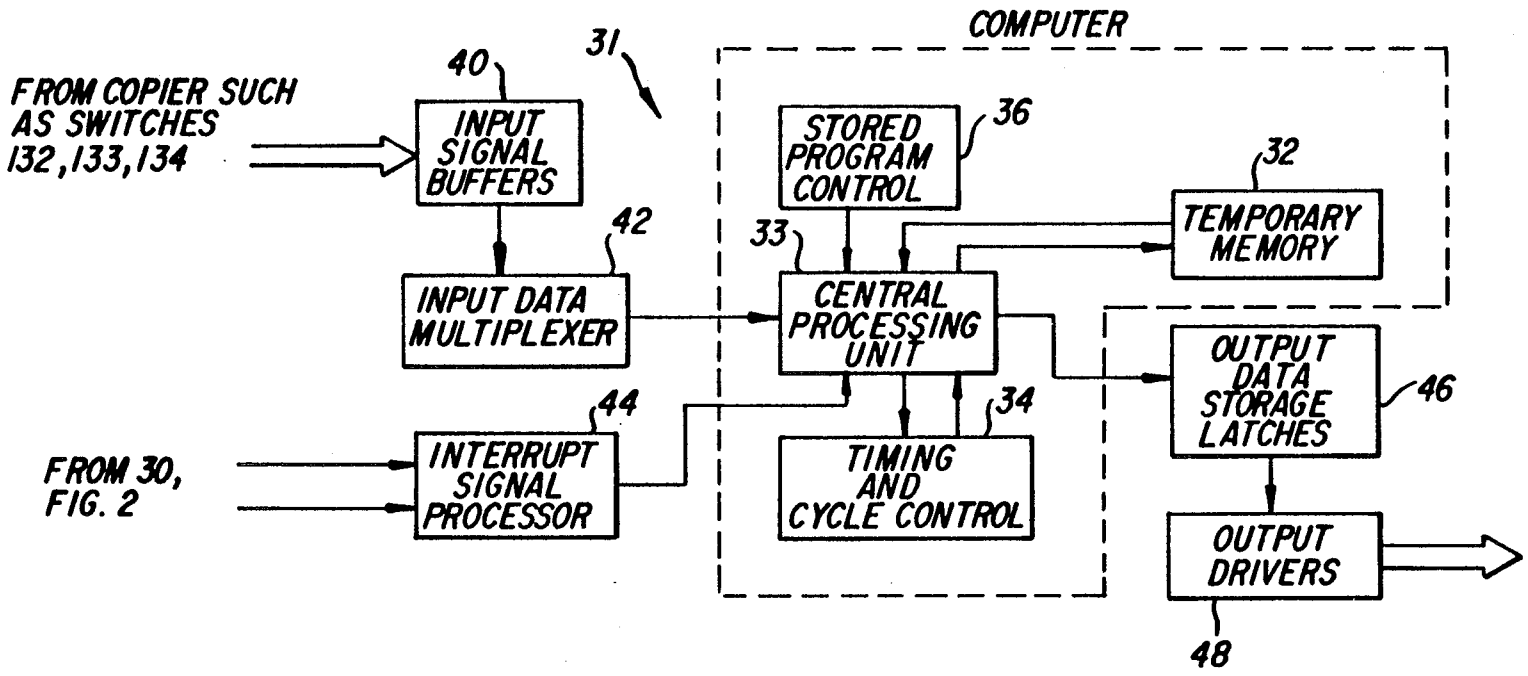
FIG. 3 is a block diagram of the logic and control unit of the apparatus of FIG. 2.

Referring to FIGS. 2 and 3, there is schematically illustrated electrophotographic apparatus 1 (referred to herein as a copier). Only those features of the copier which are helpful for a full understanding of the preferred embodiment are described hereinafter. However, more complete description of the copier may be found in commonly assigned U.S. Pat. No. 3,914,047, patented Oct. 21, 1975, in the names of Hunt et al.

A recirculating feeder 50 is positioned on top of an exposure platen 2. Feeder 50 places an original document S with the selected side C facing an exposure platen 2. When energized, two lamps 3 and 4 illuminate the selected side C of the original sheet S. By means of an object mirror 6, a lens 7, and an image mirror 8, a light image of the selected side C is reflected back from the exposure platen 2 and projected as an inverse or mirror image onto a discrete section of a photoconductive web 5. The photoconductive web 5 has a photoconductive surface 9 and a transparent support backing and is trained about rollers 10, 11, 12, 13, 14 and 15. Roller 10 is coupled to a drive motor "M" which is connected to a source of potential "V" when a switch "SW" is closed by a logic and control unit (LCU) 31 to move web 5 in a clockwise direction indicated by arrow 16.

Copier 1 includes a charging station 17, an exposing station 18, a developing station 19, a post development erase station 20, and a cleaning station 25. The details and operation of such a copier is shown in greater detail in U.S. Pat. No. 3,914,047, the contents of which is hereby incorporated by reference.

A copy duplex station 70 includes a first image transfer station 21', a copy sheet inverter or turn around device 60 and a second image transfer station 21. Copy sheets S' are supported in supply bins 23 and 24. A copy sheet S' is transported from either of bins 23 or 24 to a sheet registration device 22 where movement of sheet S' is checked to assure its arrival at first image transfer station 21' in registration with the arrival of the first unfixed electroscopic image at station 21' for electrostatic transfer to the first side C' of sheet S'. Copy sheet inverter 60 is shown as an endless vacuum belt 62 which is in vacuum contact with the unimaged side of sheet S' as it separates from web 5 due to known detacking techniques and to the change of direction of web 5 as it passes over roller 13. After belt 62 has transported sheet S' along sheet inversion path 64, the direction of belt 62 is reversed, so as to transport the second unimaged side C'' of sheet S' into transfer contact with web 5 at second transfer station 21 in registration with the second unfixed electroscopic image on web 5.

After transfer of both unfixed electroscopic images to copy sheet S', it is transported to fuser 27 including opposed rolls **27*a* and 27*b*. Duplex copy sheet S' may be transported to an output tray 29 or to a copy handling accessory 80** such as a finisher.

To coordinate operation of the various work stations 17, 18, 19, 60 and 25 with movement of the image areas on the web 5 past these stations, the web has a plurality of perforations, not shown, along one of its edges. At a fixed location along the path of web movement, there is provided suitable means 30 for sensing web perforations. This sensing generates input signals into LCU 31 having a digital computer. The digital computer has a stored program responsive to the input signals for sequentially actuating then de-actuating the work stations as well as for controlling the operation of many other machine functions as disclosed in U.S. Pat. No. 3,914,047.

Turning now to FIG. 3, a block diagram of a typical logic and control unit (LCU) 31 is shown which interfaces with the copier 1 and the feeder 50. The LCU 31 consists of temporary data storage memory 32, central processing unit 33, timing and cycle control unit 34, and stored program control 36. Data input and output is performed sequentially under program control. Input data is applied either through input signal buffer 40 to a multiplexer 42 or to signal processor 44 from perforations detected on web 5. The input signals are derived from various switches, sensors, and analog-to-digital converters. The output data and control signals are applied to storage latches 46 which provide inputs to suitable output drivers 48 which are directly coupled to leads which, in turn, are connected to the work stations. The LCU 31 processing functions can be programmed by changing the instructions stored in the computer memory.

Sensors 132, 133 and 134 spaced along the copy sheet path provide inputs along leads 140, 141 and 142 respectively to LCU 31 to indicate copy sheet jam conditions which may necessitate shutdown of copier 1 in order to prevent damage to the various components thereof.

Leads 144 and 146 from feeder 50 and copy sheet inverter 60, respectively, provide inputs to and receive outputs from LCU 31 to synchronize the operation of these devices to produce duplex copy sheets by copier 1. Lead 148 from accessory 80 also provides inputs and receives outputs from LCU 31 to synchronize the operation thereof with the operation of copier 1.

Operator control panel 150 shown in FIG. 2 includes a plurality of operator actuatable switches (buttons). For example, a numerical keyboard includes ten buttons for each of the numbers zero to nine, inclusive, and a star "*" button 152 which is actuated by the operator to designate originals as first pages of subsets.

Copier 1 and feeder 50 may be operated in either a non-collate or collate mode. The originals which are fed to exposure platen 2 may either have images on both sides (duplex) or may have images only on one side (simplex). Similarly, the copies which are produced by copier 1 may be images on either one or two sides of the copy. Thus, if duplex output is not desired, then a "No" button would be actuated. If duplex output is desired, then the operator would either depress one button if one sided originals were placed in feeder 50 or another button if two sided originals were recirculated by the feeder.

Control panel 150 also includes a display upon which messages are shown to indicate to the operator what mode the copier is operating in, what action should be taken next, where jams may be located in the copier, etc.

For the purposes of this application, when the copier is in a mode wherein the first page of a duplex copy subset is to be copied on the front of a copy sheet, it will be referred to as the "right hand chapterization mode" and when the copier is in a mode wherein a page of a duplex copy subset is to be copied on the rear of a copy sheet, it will be referred to as the "left hand chapterization mode." In effect, the left hand chapterization mode results in one page being produced on the back of a copy sheet and the remaining pages of the subset being treated as a right hand chapter.

Figure 1:
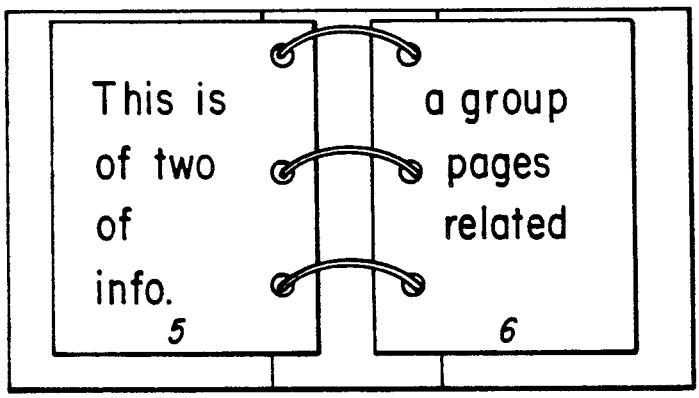
FIG. 1 is a schematic view of an open notebook with pages arranged in accordance with the present invention.
Figure 4:
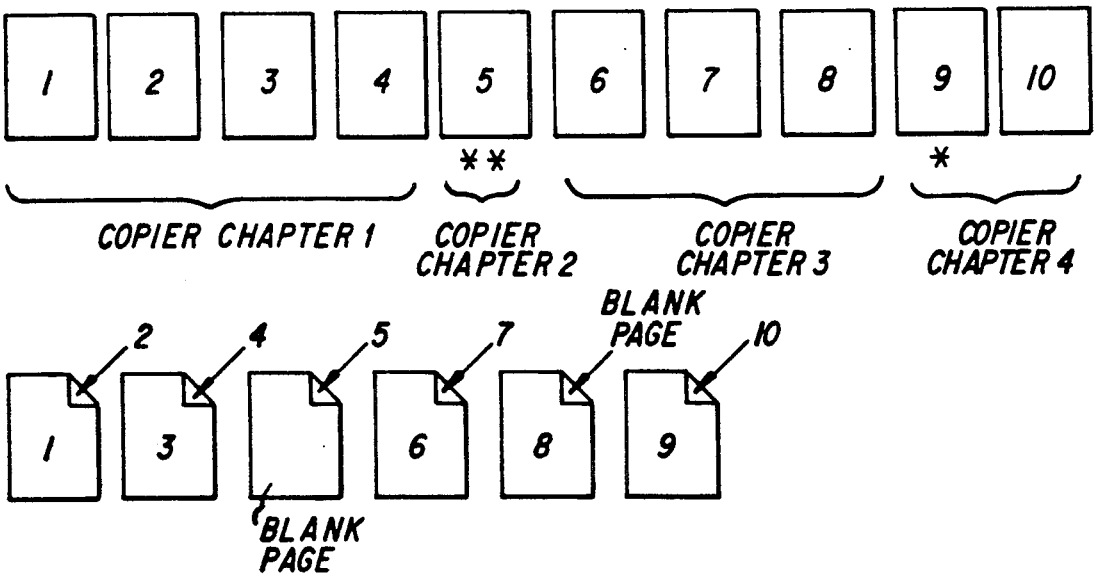
FIG. 4 is a view of original documents and copy sheets produced in accordance with the present invention.

FIG. 4 illustrates a ten-page job in which both right and left hand chapterization has been used. The top row of FIG. 4 illustrates ten original pages, of which the operator has designated page five as the first page of a left hand chapter and page nine as the first page of a conventional right hand chapter. These are denoted on the drawing by two astrixes (**) adjacent page five and one astrix (*) adjacent page nine. Of course, page one is automatically designated the first page of a right hand chapter, and, as mentioned above, pages six to eight will be handled as a right hand chapter.

The bottom row of FIG. 4 illustrates the copy sheets to be produced. A blank page has been left on the front of page five so that pages five and six can be simultaneously visible to a reader when the copy set is bound. Also, a blank page has been left on the back of page eight so that page nine can start a new right hand chapter.

Figure 5:
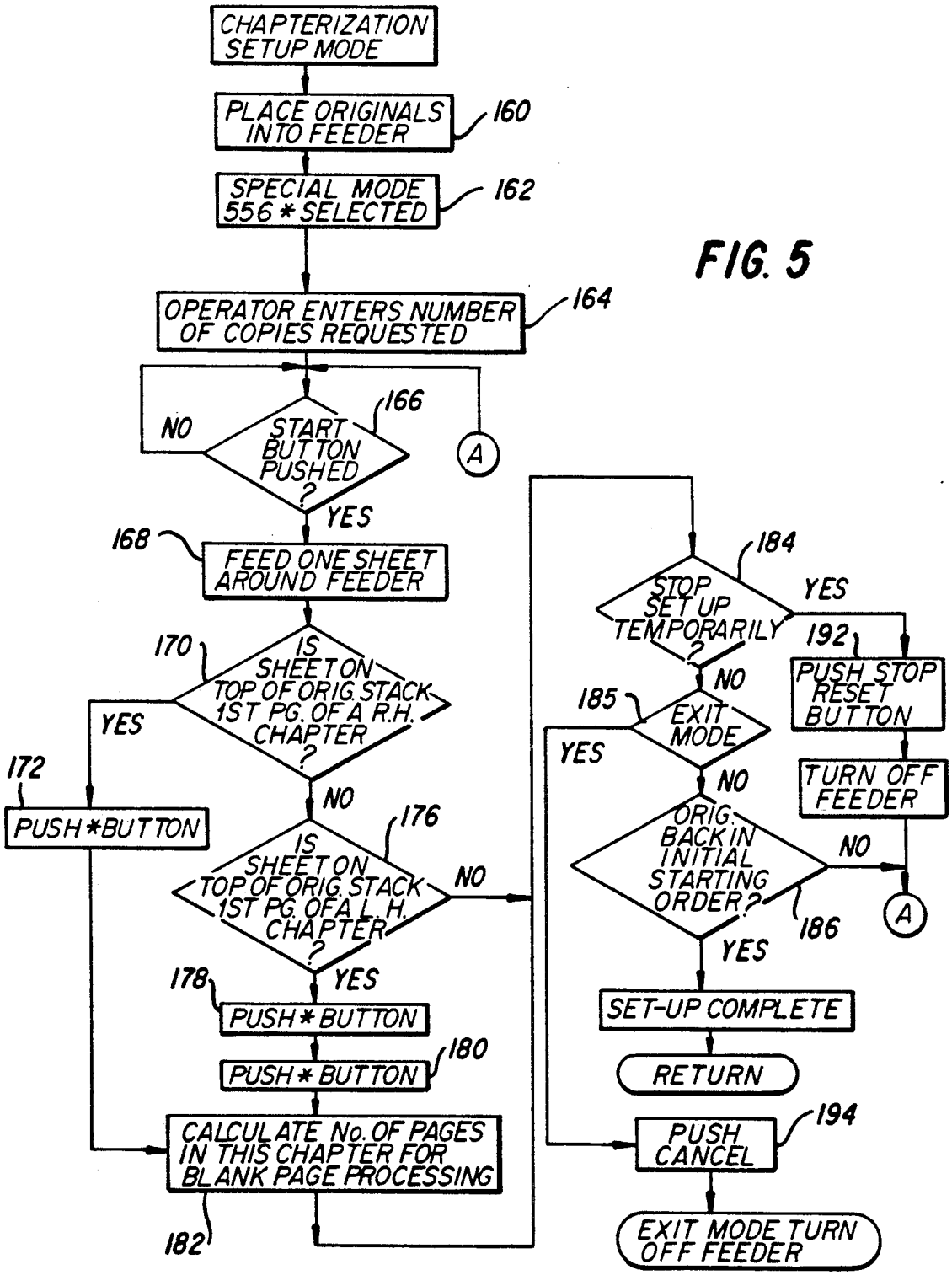
FIG. 5 is a flow chart of the setup mode of operation of the apparatus of FIG. 1.
Figure 6:
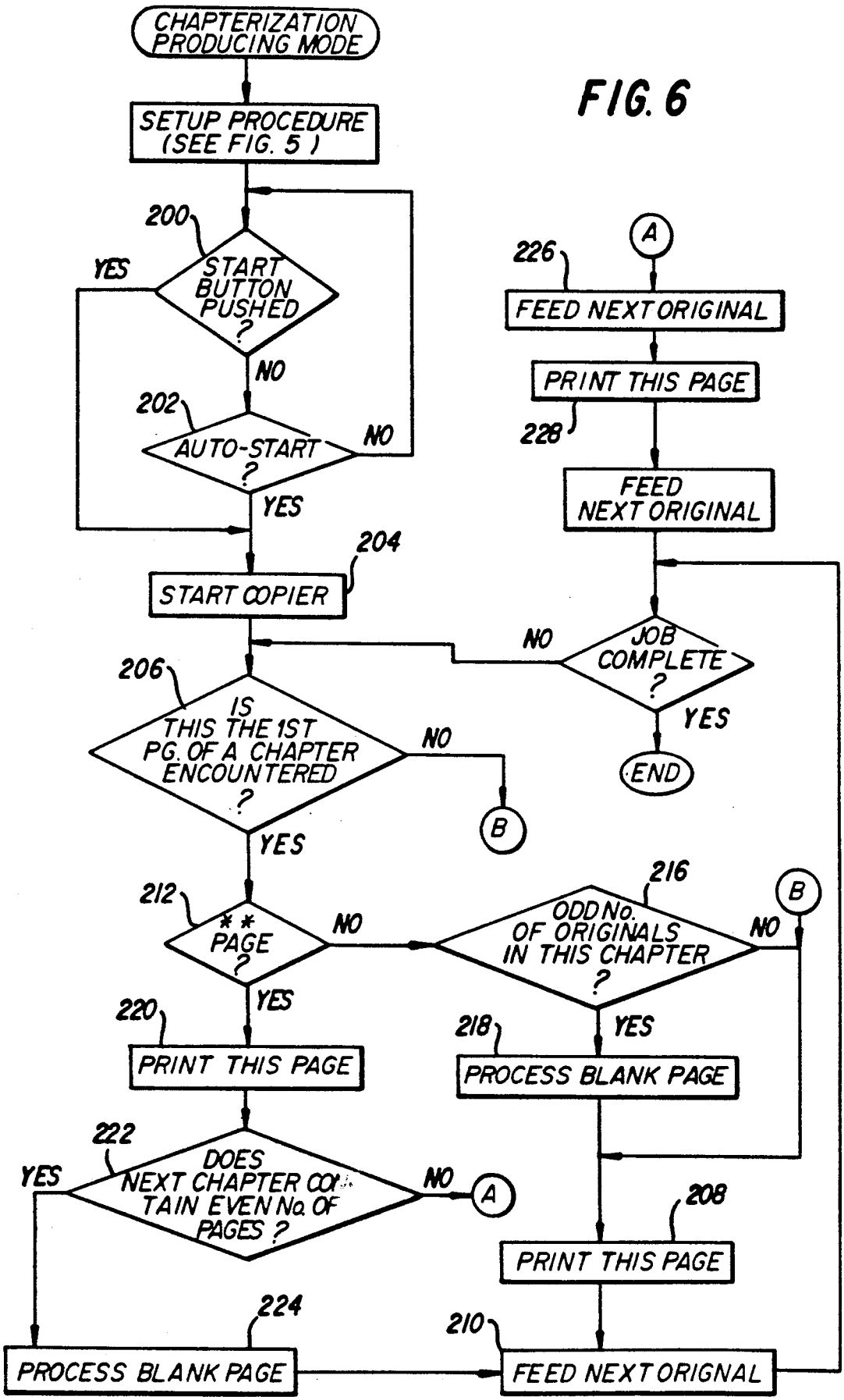
FIG. 6 is a flow chart of the producing mode of operation of the apparatus of FIG. 1.

In FIG. 5, there is shown a flow chart of the setup mode operation of the apparatus of FIG. 2; flow charts of the producing mode are shown in FIG. 6. The chapterization mode includes a setup mode and a producing mode. The operator places a set of originals into feeder 50; step 160. The originals are in page sequential order with the highest numbered original on the bottom of the set.

The operator now indicates to LCU 31 that copier 1 is to be operated in the special chapterization mode by twice depressing the "5" button on numerical keyboard of operator control panel 150, then the "6" button, and finally the axtrix (*) button 152 (556*); step 162. The last instruction to be entered on operator control panel 150 is the number of copies requested of each set which is entered on the numerical keyboard; step 164.

Feeder 50 is now under the manual control of the operator and originals may be sequentially recirculated to the top of the set by repeatedly actuating the start button; steps 166 and 168. As an original is fed, a decision is made by the operator at step 170 whether the original which has circulated to the top of the set is one that is the first page of a right hand chapter. If so, the operator pushes the astrix (*) button once (step 172), and a calculation is made and stored of the number of pages in the right hand chapter for later use; step 182.

If the decision at step 170 was no, the operator now decides if the original which has circulated to the top of the set is one that is the first page of a left hand chapter, step 176. If so, the operator pushes the astrix (*) button twice (steps 178 and 180), and a calculation is made and stored of the number of pages in the left hand chapter.

If the decisions at steps 170 and 176 were no or if the calculation of step 182 has been completed, and if no decision has been made at step 184 to temporarily stop the setup or at step 185 to exit the setup, the originals are checked at step 186. If the originals are not yet back in their initial starting order, then the routine will be returned via path "A" to circulate another original when the start button is again pushed.

If the decision at either step 170 or 176 is that the original on top of the original stack is the first page of a subset, then the operator presses the astrix (*) button 152 once or twice, respectively, to store in memory 32 the number of the original which is to be so processed. Since logic and control unit 31 has been counting the number of originals which have been circulated from the bottom of the set placed in feeder 50, it calculates at step 176 the number of originals in each chapter.

If the operator elects a right hand chapter and the number of originals in a chapter is even then copying will be carried out normally. If, on the other hand, the number of original sheets in a right hand chapter is odd, then the back page of the last duplex copy sheet in the chapter will be processed as a blank page. This can be effected by means of an erase lamp, not shown, which extends the width of web 5 and is located between exposure station 18 and development station 19.

If the operator elects a left hand chapter and the number of originals in a chapter is odd then copying will be carried out normally. If, on the other hand, the number of original sheets in a left hand chapter is even, then the back page of the last duplex copy sheet in the chapter will be processed as a blank page.

If it is desired to stop the setup mode temporarily, a stop button is actuated to turn off the feeder for a short period of time; step 184. The routine would then return to "A" by pushing a stop button at step 192 to circulate another original. If on the other hand, it is desired to exit or cancel the setup mode, then a cancel button is actuated by the operator, step 194, to turn feeder 50 off and to return copier 1 to its normal operating mode.

When the last original to be circulated is back in the initial starting order, the setup mode is completed and the copier is ready to start the producing mode (FIG. 6). This may be effected by pushing a start button; step 200. The copier may be programmed, however, to start automatically, step 202, after setup and after a predetermined delay period. In either event, the copier is started to produce duplex copies from the simplex originals in feeder 50 (step 204).

The first sheet is feed from the bottom of the stack of originals in feeder 50. Decisional step 206 determines if the first sheet fed from the bottom of the stack (page 10 in the illustrated example of FIG. 4) is the first encountered page of a chapter. In the example, the decision will be "yes" for pages 10, 8, 5, and 4 and will be "no" for pages 9, 7, 6, 3, 2, and 1.

If the decision of step 206 is "no", then the page is printed, step 208, and the next original is fed, step 210. If, on the other hand, the decision of step 206 was "yes", the logic exits to a decisional block 212 whereat it is determined if the page is a left hand chapter ("yes" decision) or a right hand chapter ("no" decision). If it is the first page of a right hand chapter (pages 10, 8, or 4 of the FIG. 4 example), the logic exits along path 216. If the right hand chapter has an even number of pages as determined in decisional block 216, the page (10 or 4) is printed at step 208 and the next page fed. If the right hand chapter has an odd number of pages, a blank page is processed, step 218, before the page is printed at 208.

Had the page been a left hand rather than a right hand chapter, the decision at block 212 would have been "yes" and the logic would have exited to step 220 to print page 5. After printing the right hand chapter page, decisional step 222 determines if the next chapter contains and even or odd number of pages. If even, a blank page is processed, step 224, before the next page is fed at 210.

If the decision at block 222 is "no", the next original is fed, step 226, and printed, step 228. If the job is not completed, the process is repeated for the next page encountered.

From the foregoing, it will be apparent that the disclosed invention provides a particularly advantageous means for producing a set of duplex copies in which the first page of each subset is on the back side of a copy.

The invention has been described in detail with particular reference to a preferred embodiment thereof, but it will be understood that variations and modifications can be effected within the spirit and scope of the invention. For example, the copier can readily be a single pass duplex model or an electronic copier with a multi-page job buffer.

What is claimed is:

1. In apparatus for copying a set of simplex originals to produce a set of duplex copies, the improvement comprising:

means for producing subsets of said duplex copies;

means for designating the first page of each of said subsets; and means for causing said first page of each subset to be produced on the back side of a copy sheet, whereby said first page appears adjacent to the next succeeding page of the subset.

2. Apparatus for copying a set of originals to produce a set of duplex copies having subsets in which the first page of each subset is on the back side of a copy sheet, said apparatus comprising:

producing means for producing images of originals, said producing means including an exposure position;

circulating means for receiving a set of originals at a receiving position and for sequentially advancing individual originals from said receiving position to said exposure position;

supply means for selectively supplying copy sheets to receive images from said producing means; and control means operable (1) in a setup mode for controlling said circulating means to circulate originals one at a time under operator control, said control means including operator actuatable means for designating at least one individual original page as the first page of a subset of copies and (2) in a producing mode for controlling (a) said circulating means to circulate said originals to said exposing position, (b) said producing means to produce sequential images of said originals, and (c) said supply means to supply to said producing means copy sheets to receive images of original pages on the front and back sides of said copy sheets with the designated first page of a subset being received on the back side of a copy sheet, whereby said first page appears adjacent to the next succeeding page of the subset.

3. The apparatus of claim 2 wherein said control means is operable:

in said setup mode, to count the number of original pages to be copied in each subset to determine if such number is odd or even; and in said producing mode, to process the back side of the last copy sheet in a copy subset as a blank sheet if the number of originals in a subset is even.

4. Electrophotographic apparatus for copying a set of originals to produce a set of duplex copies having subsets in which the first page of each subset is on the back side of a copy, said apparatus comprising:

A. an image producing section including a moving photoconductive member upon which transferable images are formed and including an exposure platen;

B. a circulating feeder located adjacent to said exposure platen, said feeder including a tray for receiving a set of simplex originals in page sequential order and operable to feed originals sequentially from the bottom of a received set to said exposure platen;

C. supply means for selectively supplying copy sheets to receive images from said image producing section; and D. programmable control means operable:

(1) in a setup mode for controlling said circulating feeder to circulate originals one at a time under operator control, said control means including means for generating a count signal as each original is circulated and further including operator actuatable means for designating original pages which have been circulated as ones to be copied as the first pages of copy subsets such that the positions of designated originals within said set of originals is stored by said control means; and (2) in a producing mode for controlling (a) said circulating feeder to circulate originals sequentially to said exposure platen, (b) said image producing section to form transferable images of said originals on said photoconductive member, and (c) said supply means to supply copy sheets to said image producing section to receive images of said originals on the front and back sides of said copy sheets with the designated first pages of each subset being received on the back side of a copy sheet, whereby said first page appears adjacent to the next succeeding page of the subset.

5. The apparatus of claim 4 wherein said control means is operable:

in said setup mode, to count the number of original pages to be copied in each subset to determine if such number is odd or even, and in said producing mode, if the number of original pages to be copied in a subset is even, to process the back side of the last copy sheet in a copy subset as a blank sheet.

* * * * *